US009533313B2

(12) United States Patent
Anderson

(10) Patent No.: US 9,533,313 B2
(45) Date of Patent: Jan. 3, 2017

(54) JET SHOWER SPRAYER

(71) Applicant: Carl Anderson, Grosse Pointe, MI (US)

(72) Inventor: Carl Anderson, Grosse Pointe, MI (US)

( * ) Notice: Subject to any disclaimer, the term of this patent is extended or adjusted under 35 U.S.C. 154(b) by 0 days.

(21) Appl. No.: 14/754,846

(22) Filed: Jun. 30, 2015

(65) Prior Publication Data

US 2016/0001306 A1 Jan. 7, 2016

Related U.S. Application Data

(60) Provisional application No. 62/020,022, filed on Jul. 2, 2014.

(51) Int. Cl.

| | |
|---|---|
| ***A62C 2/08*** | (2006.01) |
| ***B05B 1/18*** | (2006.01) |
| ***B05B 1/20*** | (2006.01) |
| ***B05B 15/06*** | (2006.01) |
| ***E03C 1/04*** | (2006.01) |
| ***E03C 1/06*** | (2006.01) |
| *B05B 1/16* | (2006.01) |

(52) U.S. Cl.

CPC ..... *B05B 1/18* (2013.01); *B05B 1/207* (2013.01); *B05B 15/066* (2013.01); *E03C 1/0408* (2013.01); *E03C 1/0409* (2013.01); *E03C 1/06* (2013.01); *B05B 1/16* (2013.01)

(58) Field of Classification Search

CPC ..... B05B 1/18; B05B 1/185; B05B 1/205; B05B 1/207

USPC ..... 239/268, 450, 556, 565, 566, 548

See application file for complete search history.

(56) References Cited

U.S. PATENT DOCUMENTS

| | | | | |
|---|---|---|---|---|
| 2,240,611 A * | 5/1941 | Derdeyn | B05B 1/207 239/267 |
| 4,271,543 A * | 6/1981 | Martin | E03C 1/066 239/282 |
| 4,562,963 A * | 1/1986 | Butler | B05B 1/207 239/266 |
| 5,230,472 A * | 7/1993 | McCabe | B05B 1/18 239/443 |
| 6,779,744 B1 * | 8/2004 | Marine | B05B 1/205 239/266 |

* cited by examiner

*Primary Examiner* — Davis Hwu

(74) *Attorney, Agent, or Firm* — Fildes & Outland, P.C.

(57) ABSTRACT

A jet shower sprayer includes three or more tubular distribution members connected together end to end forming an endless fluid path therein. Each tubular distribution member includes a plurality of nozzle openings. A water supply port is connected to and in fluid communication with the tubular distribution members.

13 Claims, 3 Drawing Sheets

JET SHOWER SPRAYER

CROSS REFERENCE TO RELATED APPLICATION

This application claims the priority of U.S. Provisional Application No. 62/020,022 filed Jul. 2, 2014.

TECHNICAL FIELD

This invention relates to showers, and more particularly to a sprayer for distributing a spray of water in a shower.

BACKGROUND OF THE INVENTION

It is known in the art relating to showers to provide a shower head or sprayer that typically includes a circular nozzle that produces a spray of water over a shower occupant's head. The shower head may be fixed in place on a wall of the shower or may include a handheld sprayer connected to a flexible supply line to allow a user to optionally move and hold the sprayer at any of a number of various positions. The shower head also may include an adjustable sprayer that can be selectively operated in a plurality of spray modes/patterns.

However, typical shower heads and sprayers use an excessive amount of water. Also, typical shower heads/sprayers are not designed to be used both by average adults as well as children, the elderly, and the handicapped. In fact, a need exists for a shower head/sprayer that is accessible to and operable by the elderly and handicapped while also being useful to the average adult.

SUMMARY OF THE INVENTION

The present invention provides a jet shower sprayer that saves water (lower water consumption per unit time) and that is fully adjustable for use by an average adult as well as children, the elderly, and the handicapped.

More particularly, a jet shower sprayer in accordance with the invention includes three or more tubular distribution members connected together end to end forming an endless fluid path therein. The tubular distribution members each include a plurality of nozzle openings. A water supply port is connected to and in fluid communication with the tubular distribution members.

The plurality of nozzle openings may be linearly disposed. Each tubular distribution member may be rotatable about its longitudinal axis allowing the plurality of nozzle openings to be directed to create spray patterns. Each nozzle opening may be generally 0.0400 inches in diameter.

A cross bar may be connected to the tubular distribution members for mounting the shower sprayer. An arm may be attachable to the cross bar. The cross bar may include a bracket pivotally attaching the shower sprayer and arm. A slide bar may slidably and rotatably connect the arm. A flexible water supply line may have one end connectable to the water supply port and another end connectable to a water supply. A valve may be disposed between the supply line and the spray distributor. A spring tensioner may be engaged with the tubular distribution members.

In another embodiment, a jet shower sprayer in accordance with the invention includes four tubular distribution members connected together end to end forming an endless fluid path therein. Each tabular distribution member includes a linearly disposed plurality of nozzle openings. Each tubular distribution member is rotatable around its longitudinal axis for selectively positioning the nozzle openings. A water supply port is connected to and in fluid communication with the tubular distribution members. The sprayer further includes a meant including: a cross bar including a bracket detachably extending from the shower sprayer, a wall mountable slide bar, and an arm having an end slideable on the slide arm and another end rotatably connected to the cross bar bracket adjustably connecting the shower sprayer.

These and other features and advantages of the invention will be more fully understood from the following detailed description of the invention taken together with the accompanying drawings.

DETAILED DESCRIPTION OF THE INVENTION

Figure 1:
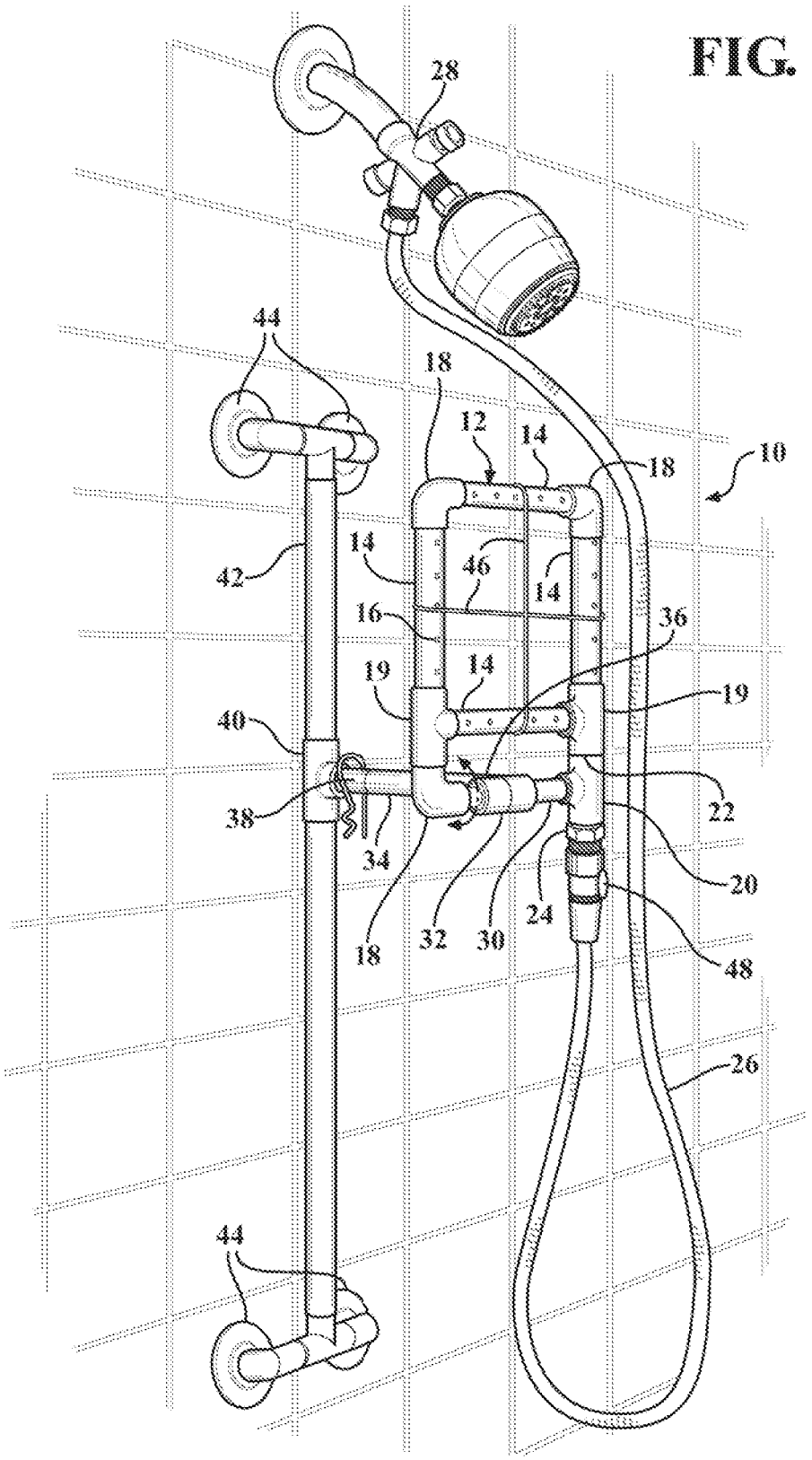
FIG. 1 is a perspective view of an embodiment of a jet shower spray assembly in accordance with the present invention.
Figure 2:
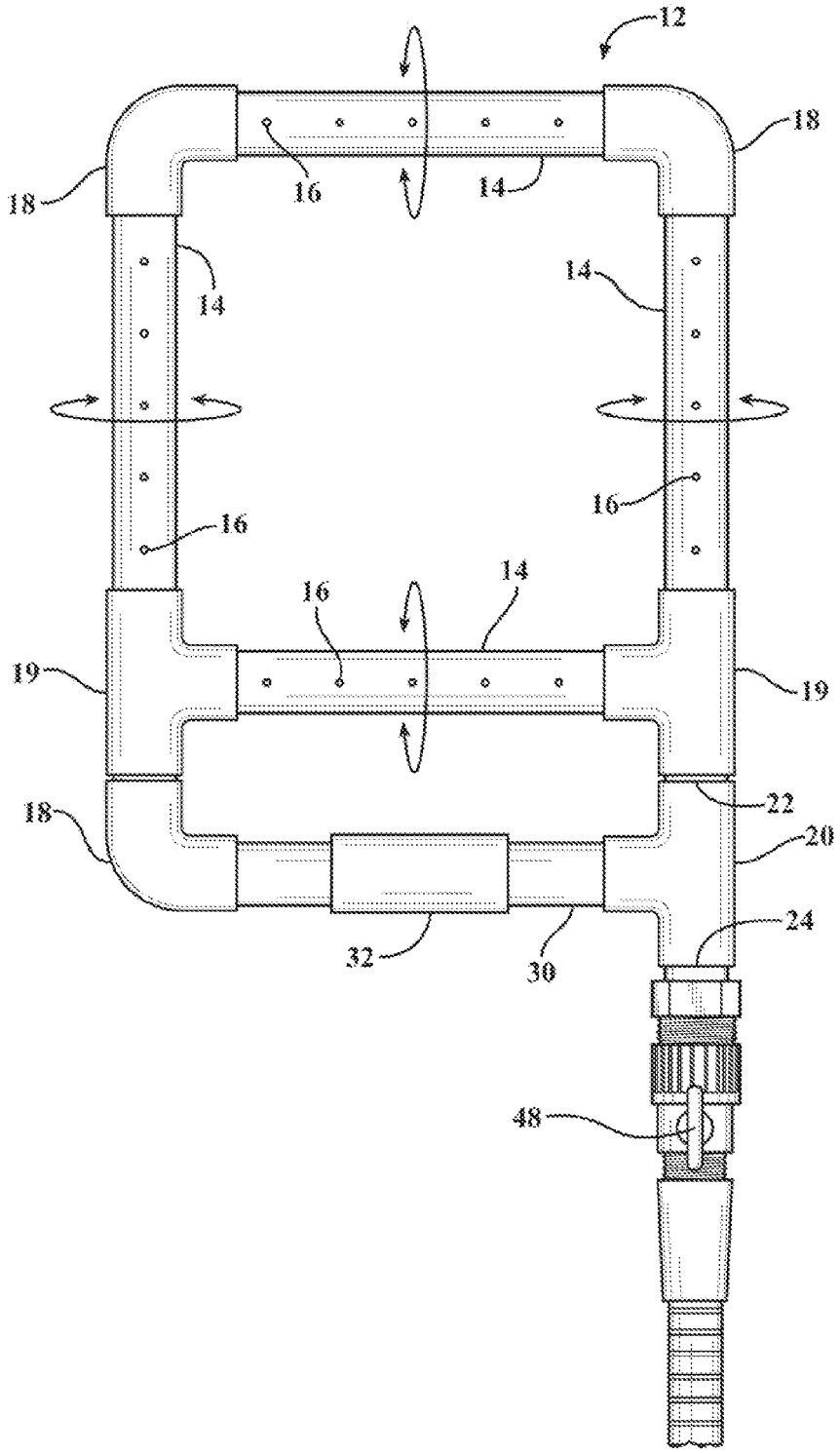
FIG. 2 is a front view of a spray distributor of the jet shower sprayer illustrating 360-degree rotation of its distribution members.
Figure 3:
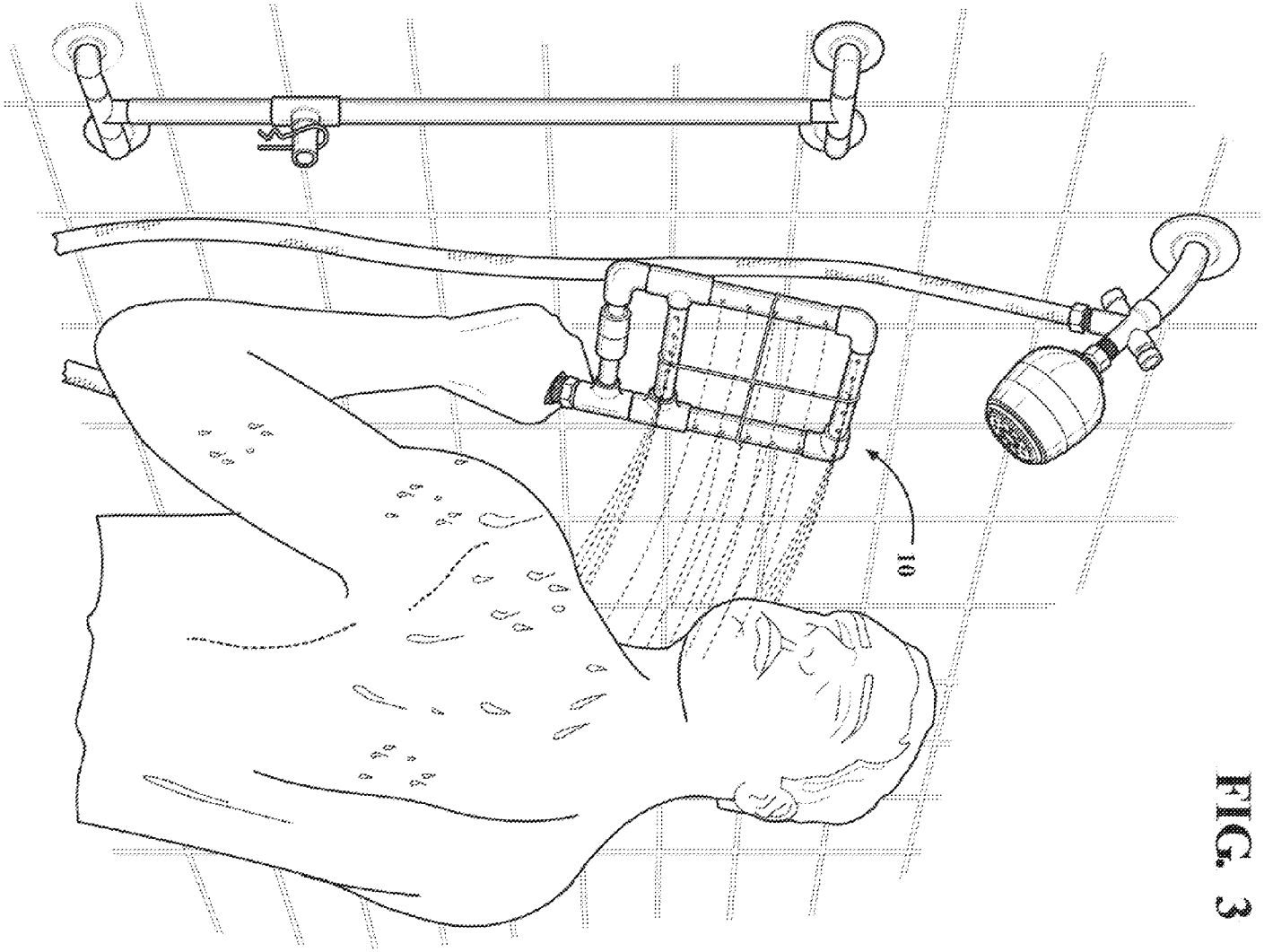
FIG. 3 is an environmental view of the jet shower sprayer illustrating a spray pattern formed by nozzle openings of the distribution members.

Referring now to the drawings in detail, numeral 10 generally indicates a jet shower sprayer in accordance with the invention. The jet shower sprayer 10 includes a spray distributor 12 that includes three or more adjustable distribution members 14. Each distribution member 14 may be a tube/pipe that includes a plurality of nozzle openings 16. Adjacent distribution members 14 are connected at their ends by angled, tubular connectors 18, 19 such that the three or more distributions members are in fluid communication, and form a loop that defines an n-sided geometric shape such as a triangle, square, pentagon, etc. Each distribution member 14 is rotatable 360 degrees about its longitudinal axis to allow for adjustment of the disposition of the nozzle openings 16. The distribution members 14 may or may not be of equal length.

One of the connectors 19 of the spray distributor 12 may be connected to a water supply port 20. The supply port 20 has an outlet 22 that is connected to one of the connectors 19, and an inlet 24 that is connected to a flexible supply line 26 (e.g., flexible hose) that receives water from a water source. The flexible supply line 26 may be connected to a 2-way or 3-way diverter 28 at the water source. The supply port 20 is connected to at least one other connector 18 of the spray distributor 12 by a crossbar 30.

The crossbar 30 is mounted on a bracket 32. The crossbar 30 is freely rotatable on the bracket 32 to allow for angular adjustment of the disposition of the spray distributor 12. Rotation of the crossbar 30 on the bracket 32 changes the angle that the spray distributor 12 faces upwards or downwards.

The bracket 32 is connected to an arm 34 and is freely rotatable about an end 36 of the arm, allowing for 360 degree rotation of the spray distributor 12. An opposite end 38 of the arm is connected to a slide 40 that is slidable along a slide bar 42. The slide bar 42 may be generally vertically disposed, whereby movement of the slide 40 along the slide bar adjusts the height of the spray distributor 12. The slide bar 42 may be mounted along a wall of a shower. For example, the slide bar 42 may be mounted on a wall by a pair of upper and lower suction cup mounts 44 that allow for adjustable mounting and dismounting of the slide bar in the shower. Thus, the slide bar 42 and connected spray distributor 12 may be changeably mounted in various locations in the shower, restricted only by the length of the flexible supply line 26.

Due to the construction of the jet shower sprayer 10, the location, height, and disposition of the spray distributor 12 can be adjusted to nearly any orientation. Further, due to the 360 degree rotatability of the distribution members 14 of the spray distributor, numerous spray patterns can be formed by rotation of one or more of the distribution members. The adjustability of the distribution members 14 and resulting adjustable spray pattern provides a massage factor for massaging the human body, thereby having therapeutic results. The massage factor provided by the present jet shower sprayer 10 is not attainable with other shower sprayers. Still further, the spray distributor 12 can be removed from a mounted disposition in order to be hand held. When hand-held, the spray distributor 12 may be moved around the body for targeted massaging and cleaning. Also, in this mode the jet shower sprayer 10 may be used to clean soap, dirt, grime, and the like off walls, the ceiling, etc.

In a specific embodiment, the spray distributor 12 includes four tubular distribution members 14 that are connected together at right angles to form a square. Each distribution member 12 is a 5 inch tube having a ⅝ inch outside diameter and a ⅜ inch inside diameter. The tube may be made of acrylic or CPVC, or any other similarly suitable material. Each tubular distribution member 12 includes five nozzle openings 16 which are each 0.0400 inches in diameter and which are generally linearly, evenly arranged longitudinally along the 5 inch tube. Two of the connectors 18 connecting together the distribution portions are 90-degree elbows, and the other two connectors 19 are tee connectors. An annular seal such as an O-ring or similar may seal each of the connections between the ends of the tubes and the ends of the connectors. Opposite sides of the spray distributor 12 may be reinforced by connecting a spring tensioner 46 or similar between each set of two oppositely disposed tubes.

The water supply port 20 may be a tee connector whereby the arms of the tee form the inlet 24 and outlet 22 of the port and the leg of the tee is connected to the crossbar 30. In this embodiment, the crossbar 30 is formed of two separate pieces of tubing which are connected to but not adhered to the arms of another tee connector which forms the bracket 32. The tee connector forming the bracket 32 is disposed between the two pieces of tubing, and the pieces of tubing are freely rotatable in the tee connector. An outer end of one of the pieces of tubing is connected to the leg of the water supply port 20, and an outer end of the other piece of tubing is connected to one of the tee connectors 19 of the spray distributor 12 by a 90 degree elbow. The connection between the leg of the water supply port 20 and the crossbar 30 may be sealed shut by a cork block or other similar seal. Likewise, the connection between the 90 degree connector connected to the other end of the crossbar 30 and the tee connector of the spray distributor 12 may be sealed shut by a cork block or similar. Thus, water may not flow through the crossbar 30.

The arm 34 connecting the bracket 32 to the slide 40 is also a piece of pipe or tubing, and the slide is another tee connector. The arm 34 is mounted on the leg of the tee connector that forms the slide 40, and the arms of the tee connector that forms the slide are mounted on the slide bar 42 for slidable movement along the slide bar. The slide bar 42 may be a tube or rod that is approximately 29 inches in length, allowing the spray distributor to be adjusted 29 inches in the vertical direction. The slide bar 12 may be formed of an acrylic tube having a ⅝ inch outside diameter and a ⅜ inside diameter. Each of the suction cup mounts 44 at the upper and lower ends of the slide bar 42 includes a centrally disposed tee connector, a pair of oppositely extending bars, and a 90 degree elbow at outer ends of each of the bars. A 1¾ inch suction cup is connected to each of the 90 degree elbows.

A volume control (e.g., adjustable valve 48) can be connected between the flexible supply line 26 and the spray distributor 12. The volume control may adjust the output of the spray distributor between 0.8 gallons per minute and 1.9 gallons per minute. In contrast, shower water usage with conventional shower heads/sprayers typically ranges between 2.5 and 6 or more gallons per minute. Therefore, the present spray distributor 12 provides a significant savings in water and sewage use.

Alternatively, the spray distributor 12 and/or other portions of the jet shower sprayer 10 may be integrally formed, such as by molding or similar.

It should be understood that the invention is not limited in its application to the details of construction and arrangements of the components set forth herein. The invention is capable of other embodiments and of being practiced or carried out in various ways. Variations and modifications of the foregoing are within the scope of the present invention. It should also be understood that the invention disclosed and defined herein extends to all alternative combinations of two or more of the individual features mentioned or evident from the text and/or the drawings. All of these different combinations constitute various alternative aspects of the present invention. The embodiments described herein explain the best modes known for practicing the invention and will enable others skilled in the art to utilize the invention.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A jet shower sprayer comprising:

three or more non-threaded tubular distribution members connected together end to end forming an endless fluid path therein;

said non-threaded tubular distribution members each including a plurality of nozzle openings;

non-threaded annular seals sealing the connections between said non-threaded tubular distribution members providing 360 degrees of selective positioning of said nozzle openings of each non-threaded tubular distribution member, each said non-threaded tubular distribution member being adjustably rotatable about its longitudinal axis during use allowing the plurality of nozzle openings to be directed to create spray patterns;

a water supply port connected to and in fluid communication with said non-threaded tubular distribution members; and a non-distribution cross bar connected to said non-threaded tubular distribution members for mounting said shower sprayer;

said non-distribution cross bar including a bracket, said non-distribution cross bar rotating around said bracket providing angular positioning of said distribution members relative to said bracket.

2. The jet shower sprayer of claim 1 wherein said plurality of nozzle openings are linearly disposed.

3. The jet shower sprayer of claim 1 wherein each nozzle opening is generally 0.0400 inches in diameter.

4. The jet shower sprayer of claim 1 including an arm attachable to said cross bar.

5. The jet shower sprayer of claim 4 including a slide bar for slidably and rotatably connecting said arm.

6. The jet shower sprayer of claim 1 including a flexible water supply line having one end connectable to said water supply port, and another end connectable to a water supply.

7. The jet shower sprayer of claim 6 including a valve between said water supply line and said spray distributor.

8. The jet shower sprayer of claim 1 including a spring tensioner engaged with said tubular distribution members.

9. A jet shower sprayer comprising:

four tubular distribution members connected together end to end forming an endless fluid path therein;

each said tubular distribution member including a linearly disposed plurality of nozzle openings;

each said tubular distribution member being rotatable around its longitudinal axis for selectively positioning said nozzle openings;

a water supply port connected to and in fluid communication with said tubular distribution members;

a mount including:

a cross bar including a bracket detachably extending from said shower sprayer;

a wall mountable slide bar; and an arm having an end slideable on said slide arm and another end rotatably connected to said cross bar bracket adjustably connecting said shower sprayer.

10. A jet shower sprayer comprising:

three or more tubular distribution members connected together end to end forming an endless fluid path therein;

said tubular distribution members each including a plurality of nozzle openings;

a water supply port connected to and in fluid communication with said tubular distribution members;

each said tubular distribution member being rotatable about its longitudinal axis allowing the plurality of nozzle openings to be directed to create spray patterns; and a non-distribution cross bar connected to said tubular distribution members for mounting said shower sprayer;

said non-distribution cross bar including a bracket, said non-distribution cross bar rotating around said bracket providing angular positioning of said distribution members relative to said bracket.

11. The jet shower sprayer of claim 10 wherein said plurality of nozzle openings are linearly disposed.

12. The jet shower sprayer of claim 10 including a spring tensioner engaged with said tubular distribution members.

13. The jet shower sprayer of claim 10 wherein each nozzle opening is generally 0.0400 inches in diameter.

* * * * *